US008481233B2

(12) United States Patent
Fujita et al.

(10) Patent No.: US 8,481,233 B2
(45) Date of Patent: Jul. 9, 2013

(54) ORGANIC PHOTORECEPTOR, IMAGE FORMING APPARATUS AND PROCESS CARTRIDGE

(75) Inventors: Toshiyuki Fujita, Tokyo (JP); Hirofumi Hayata, Tokyo (JP); Masahiko Kurachi, Tokyo (JP); Kunihiro Ogura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1143 days.

(21) Appl. No.: 12/057,445

(22) Filed: Mar. 28, 2008

(65) Prior Publication Data

US 2008/0292980 A1 Nov. 27, 2008

(30) Foreign Application Priority Data

May 25, 2007 (JP) ..... 2007-138894

(51) Int. Cl.
*G03C 1/73* (2006.01)

(52) U.S. Cl.
USPC ..... 430/57.1; 430/273.1

(58) Field of Classification Search
USPC ..... 430/57.1, 273.1
See application file for complete search history.

(56) References Cited

U.S. PATENT DOCUMENTS

| | | | | |
|---|---|---|---|---|
| 2004/0180280 | A1 * | 9/2004 | Ikegami et al. | 430/73 |
| 2005/0064318 | A1 * | 3/2005 | Shida et al. | 430/126 |
| 2006/0115761 | A1 * | 6/2006 | Itami et al. | 430/122 |
| 2006/0240346 | A1 * | 10/2006 | Toda et al. | 430/64 |
| 2007/0231721 | A1 * | 10/2007 | Nukada et al. | 430/66 |

* cited by examiner

*Primary Examiner* — Mark F Huff
*Assistant Examiner* — Rachel Zhang
(74) *Attorney, Agent, or Firm* — Lucas & Mercanti, LLP

(57) ABSTRACT

Disclosed is an organic photoreceptor comprising on an electrically conductive support a light-sensitive layer and a surface layer, wherein the surface layer comprises a resin formed by curing a photocurable compound containing at least one polar group and at least one photocurable-functional group and a particulate metal oxide having a water absorption of 0.1 to 10%. There are also disclosed an image forming apparatus and a process cartridge.

13 Claims, 3 Drawing Sheets

ORGANIC PHOTORECEPTOR, IMAGE FORMING APPARATUS AND PROCESS CARTRIDGE

FIELD OF THE INVENTION

The present invention relates to an organic photoreceptor used in the field of copiers and printers, an image forming apparatus using the organic photoreceptor and a process cartridge.

BACKGROUND OF THE INVENTION

Heretofore, there have often been problems in thermoplastic resins for use in electrophotographic photoreceptors (specifically, organic photoreceptors) such that sufficient transferability at a high temperature could not be achieved in high humidity environment or photoreceptors frequently became scratched therein, resulting in uneven half-tone images. To overcome such problems, there was attempted improvement by an electrophotographic photoreceptor provided with a protective layer, in which enhancement of the surface hardness of a photoreceptor was attempted through a curing reaction, as described in, for example, JP-A No. 8-179541 (hereinafter, the term JP-A refers to Japanese Patent Application Publication). However, a progress of the curing reaction was insufficient and image deletion in unreacted sites was caused, or resistance to abrasion or scratch was insufficient due to lowering in mechanical strength, so that a photoreceptor exhibiting stable electrophotographic characteristics could not be obtained.

In response to the foregoing problems, there was an attempt of dispersive-mixing metal oxide particles to control the resistance of a protective layer to inhibit lowering of the surface resistance, as described in JP-A No. 5-173350, or an attempt of addition of metal oxide particles exhibiting a hydrophobicity degree of 50 or more to prevent image deletion, as described in JP-A No. 2000-010821.

However, addition of metal oxide particles exhibiting a hydrophobicity degree of 50 or more to a protective layer containing a curing compound was insufficient to prevent image deletion under high temperature and high humidity, due to water or corona discharge by-products such as $NO_x$. Further, the surface layer durability was deficient and satisfactory performance was not achieved in resistance to abrasion or scratch. It is assumed to be due to that metal oxide particles disadvantageously act for reactivity of such a curing compound.

As set forth above, it is the current status that compatibility of resistance and image characteristics cannot be achieved only by the conventional technology and essential solution for these problems has not yet realized.

SUMMARY OF THE INVENTION

Accordingly, it is an object of the present invention to solve the foregoing problems, to improve the layer durability and electrical potential characteristic of an organic photoreceptor and to provide an organic photoreceptor capable of obtaining halftone images without causing image unevenness or image deletion even under an environment of high temperature and high humidity, and an image forming method, an image forming apparatus and a process cartridge by use thereof.

As a result of extensive study of the foregoing problems, the present invention has come into being by finding that it is essential for solution of the problems of an organic photoreceptor having a surface layer under high temperature and high humidity to allow a photocurable compound used the surface layer to contain a polar group and to add metal oxide particles exhibiting a relatively low hydrophobicity (that is, having a relatively high moisture-absorptive region).

Reasons therefore are assumed to be as follows. One reason is that a polar group which exists in a relatively high moisture-absorptive region on the metal oxide particle surface, catalytically promotes a curing reaction through interaction with the polar group of a curable compound. A second reason is that after completion of the curing reaction, a polar group attributed to the curable compound captures water or $NO_x$, whereby adsorption of water or $NO_x$ is reduced even in relatively high water-absorptive metal oxide particles, rendering it difficult to lower electric resistivity.

However, the foregoing phenomenon is still in the hypothetical stage and the mechanism thereof is not completely clarified.

The above mentioned object of the invention are realized by the following constitution.

Thus, one aspect of the invention is directed to an organic photoreceptor comprising on an electrically conductive support a light-sensitive layer and a surface layer, wherein the surface layer comprises a resin obtainable by curing a compound having a polar group and a photocurable functional group and a particulate metal oxide exhibiting a percentage of water absorption of 0.1 to 10%.

Another aspect of the invention is directed to an image forming apparatus comprising a developing device to develop an electrostatic image formed on an organic photoreceptor to form a toner image, a means for transferring the toner image to a transfer paper and a cleaning device for removing a toner remaining on the organic photoreceptor, wherein the organic photoreceptor comprises on an electrically conductive support a light-sensitive layer and a surface layer, and the surface layer comprises a resin formed by curing a compound containing a polar group and a photocurable group and a particulate metal oxide exhibiting a percentage of water absorption of 0.1 to 10%.

Another aspect of the invention is directed to a process cartridge, wherein the cartridge which uses the above-described organic photoreceptor in combination with one of a charger, an image exposure device, a development device and a cleaning device is designed so as to be freely transferable into and from an image forming apparatus.

The use of an organic photoreceptor, an image forming apparatus or a process cartridge according to the invention can achieve enhanced layer durability and superior potential characteristic, whereby a half-toned electrophotographic image not having image unevenness or image deletion can be obtained even under severe hygrothermal conditions such as high temperature and high humidity.

DETAILED DESCRIPTION OF THE INVENTION

Figure 1:
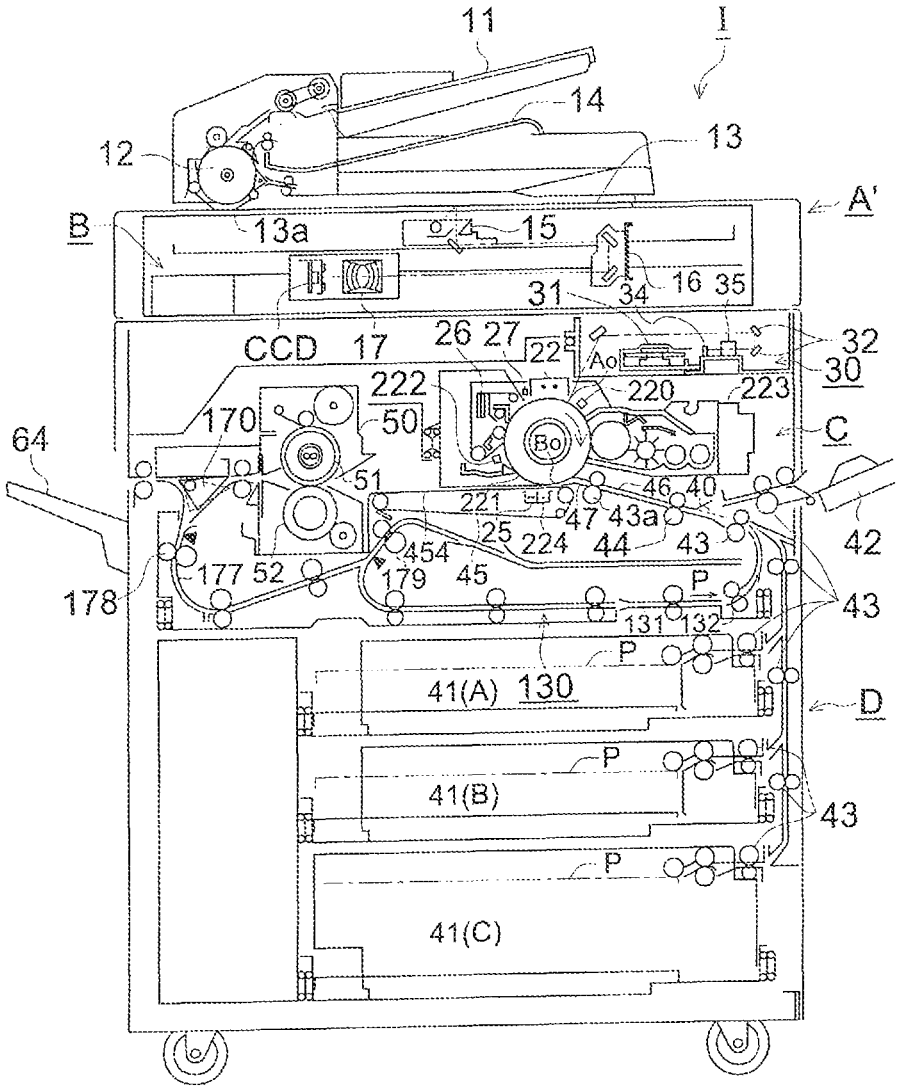
FIG. 1 illustrates an image forming apparatus relating to this invention.

The organic photoreceptor according to the invention is one which comprises a light-sensitive layer on a electrically conductive support and further thereon a surface layer containing a resin formed by curing a compound having a polar group and a photocuring functional group and a particulate metal oxide exhibiting a water absorption ratio of 0.1 to 10%.

The organic photoreceptor of the invention is constituted as above, enhanced layer durability and superior electrical potential characteristic of a toner even under severe hygrothermal conditions such as high temperature and high humidity and enabling to obtain half-toned electrophotographic images without causing image unevenness or image deletion.

Thus, the use of a resin which is formed by curing a compound having a polar group and a photocurable group minimizes unevenness of curability of the surface layer and achieves prompt curing. Further, a water absorption ratio falling within the range of 0.1 to 10% promotes a curing reaction of curing a compound having a polar group and a photocurable group to form a resin, resulting in enhanced crosslinking density. A water absorption ratio of less than 0.1% results in insufficient crosslinking density, leading to deficient layer thickness, while a water absorption ratio of more than 10% results in increased adsorption of water or corona discharge by-products such as $NO_x$ onto toner particles, whereby image unsharp tends to occur.

Particulate metal oxides usable in the invention include silicon oxides of transition metals, and preferred examples of a metal oxide include silica, zinc oxide, titanium oxide, alumina, tin oxide, antimony oxide, indium oxide, bismuth oxide, tin-doped indium oxide, antimony- or tantalum-doped tin oxide and zirconium oxide. Of these, silica, titanium oxide and alumina (aluminum oxide) are more preferred in terms of cost, controllability of particle size and ease of a surface treatment and titanium oxide is specifically preferred. A titanium oxide often exhibits electrical semiconductivity and can be controlled to superior potential characteristic and image characteristic, that is, a low residual potential and a surface resistance rendering it difficult to cause image deletion.

The metal oxide particles described above preferably exhibit a number average primary particle size of 10 to 100 nm. A number average primary particle size falling within the range of 10 to 100 nm enables homogeneous dispersion of metal oxide particles in the surface layer, resulting in reduced lowering of sharpness, due to scattering of exposure light during electrostatic latent image formation, whereby images with enhanced sharpness can be obtained. Further, aggregation of metal oxide particles is difficult to occur, inhibiting an increase of residual potential, caused by charge-trapping of the aggregate.

The number average primary particle size of metal oxide particles can be determined in such a manner that 300 random particles are electron-microscopically observed at a 10,000 fold magnification in a transmission electron microscope and measured values are calculated as a number average diameter of a Feret diameter through image analysis.

To control the water absorption of metal oxide particles so as to fall within the range of 0.1 to 10%, the surfaces of metal oxide particles are preferably subjected to a hydrophobilization treatment.

The hydrophobilization treatment can be conducted using hydrophobilizing agents. There are usable commonly known compounds as a hydrophobilizing agent. Specific examples of such compounds usable as a hydrophobilizing agent are shown below and these compounds may be used singly or in combination.

Titanium coupling agents as a hydrophobilizing agent include, for example, tetrabutyltitanate, tetraoctyltitanate, isopropyl-tri-isostearoyltitanate, isopropyl-tri-decylbenzenesulfonyltitanate, and bis(dioctylpyrophosphate)oxyacetatetitanate.

Silane coupling agents as a hydrophobilizing agent include, for example, γ-(2-aminoethyl)aminopropyltrimethoxysilane, γ-(2-aminoethyl)aminopropylmethyldimethoxysilane, γ-methacryloxypropyltrimethoxysilane, N-β-vinylbenzylaminoethyl-N-γ-aminopropyltrimethoxysilane hydrochloric acid salt, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane.

Silicon oils as a hydrophobilizing agent include, for example, dimethylsilicone oil, methylphenylsilicone oil and amino-modified silicone oil.

There may be used hydrogen polysiloxane compounds as surface-hydrophobilizing agents, as described above. Generally, hydrogen polysiloxane compounds having a molecular weight of 1,000 to 20,000 are readily available. Specifically, methyl hydrogen polysiloxane compounds used for a final surface treatment result in superior effects.

A hydrophobilizing agent, as described above is added preferably in amount of 1 to 40% by mass of metal oxide particles, and more preferably 3 to 30% by mass for coverage of the particle surface.

A hydrophobilizing treatment is conducted in a dry process in which metal oxide particles dispersed in a cloud form are sprayed with a solution of a hydrophobilizing agent dissolved in an alcohol or the like or are brought into contact with a vaporized hydrophobilizing agent, or in a wet process in which metal oxide particles are dispersed in a solution and a hydrophobilizing agent is dropwise added thereto and adhered to the particles.

Varying the kind and coverage of a hydrophobilizing agent can control the water absorption percentage of metal oxide particles.

The percentage of water absorption (or water absorption percentage) of metal oxide particles relating to the invention was determined by the Karl Fischer method. The Karl Fischer method is a method for determining amounts of contained water through a quantitative reaction of iodine and sulfur dioxide in the presence of a base of water and an alcohol. An electrical quantity required for electrolysis is derived from a quantity of iodine reacted with water and the electrical quantity is converted to an amount of water. In practice, a measurement sample is conditioned for 15 hrs. under an environment at a temperature of 30° C. and a humidity of 80% RH and dried at 140° C. for 30 min. in a micro-moisture measurement device (AQ2100, produced by Hiranuma Sangyo Corp.) to determine the percentage of water absorption (namely, percentage of water content) according to the following equation:

$$\text{Water absorption (\%)}=\{[\text{weight (g) of absorbed water of sample}]/[\text{weight (g) of sample}]\}\times 100$$

The content of metal oxide particles of the surface layer is preferably from 1 to 55 parts by mass, more preferably from 1 to 20 parts by mass, still more preferably from 2 to 15 parts by mass, and further still more preferably from 2 to 10 parts by mass, based on 100 parts by mass of a compound having a polar group and a photo-curable functional group. A content exceeding 55 parts by mass raises the residual electric potential, often resulting in reduced image density or partial image deletion. A content of less than 1 part by mass tends to lower layer hardness, resulting in reduced layer durability.

There will be described a compound having a polar group and a photo-curable functional group (which is hereinafter also denoted simply as a photocurable compound).

The polar group of the invention refers to a functional group (or an atomic group) exhibiting some polarity. A large difference in electronegativity between two bonding atoms results in polarity. The difference in electronegativity is preferably not less than 0.3 in terms of Pauling's electronegativity, and more preferably not less than 1.0. Polar groups of the photo-curable compound include, for example, —OH, —SH, —CO—, and —NH—. Preferred examples of the polar group include a —OH group, —CHO group, $—NH_2$ group, $—CO_2H$ group and —CONH—group.

Examples of a photo-curable functional group include an acryloyl group ($CH_2$=CHCOO—), a methacryloyl group [$CH_2$=C($CH_3$)COO—] and an epoxy group.

These photo-curable compounds may be contained as such in a coating solution of the surface layer, or may be polymerized to an oligomer and contained in a coating solution of the surface layer.

Specific examples of the photo-curable compound relating to the invention are shown below but the present invention is not limited to these.

(1)

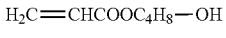

(2)

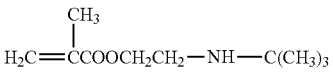

(3)

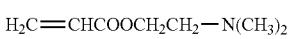

(4)

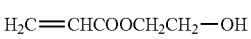

(5)

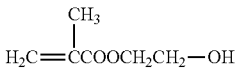

(6)

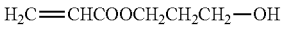

(7)

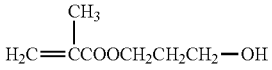

(8)

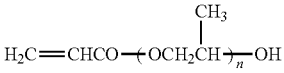

(9)

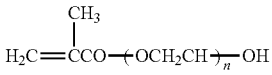

(10)

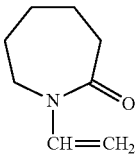

(11)

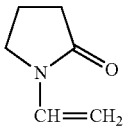

(12)

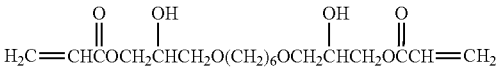

(13)

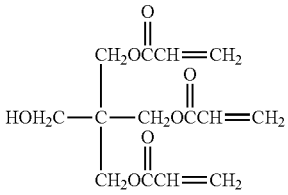

(14)

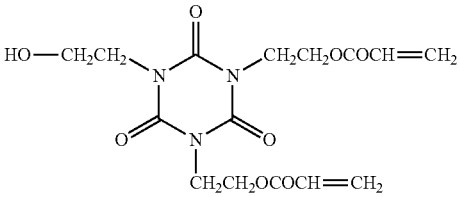

(15)

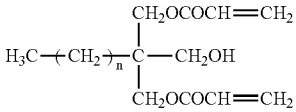

(16)

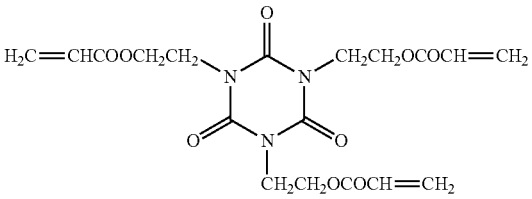

(17)

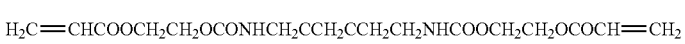

(18)

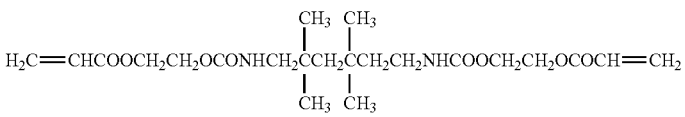

(19)

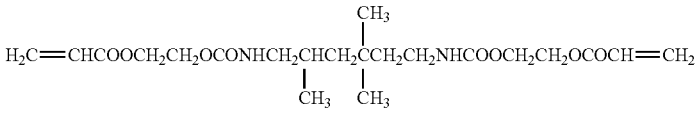

-continued (20)

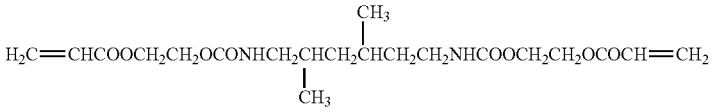

(21)

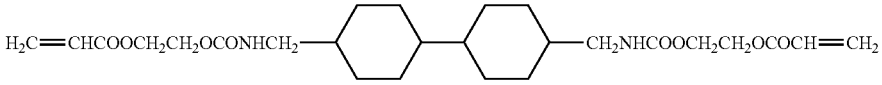

(22)

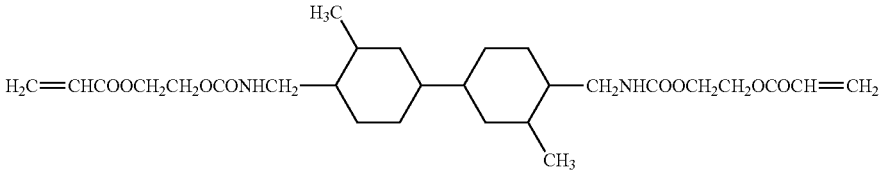

(23)

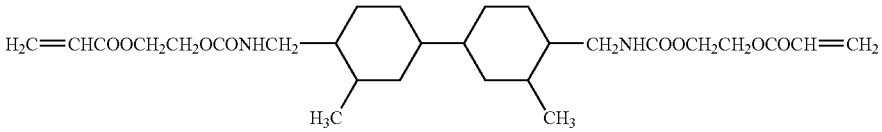

(24)

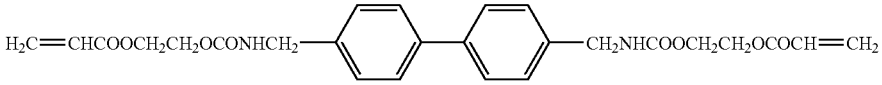

(25)

$(H_2C{=}CHCOOCH_2)_2CHOCONHCH_2CCH_2CCH_2CH_2NHCOOCH(CH_2OCOCH{=}CH_2)_2$ (26)

$(H_2C{=}CHCOOCH_2)_3CHOCONHCH_2CCH_2CCH_2CH_2NHCOOCH(CH_2OCOCH{=}CH_2)_3$ (27)

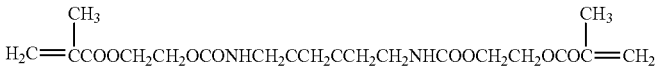

The photo-curable compound preferably has at least two functional groups and preferably, a photo-curable compound having three functional groups is preferably mixed therewith to form a network resin structure.

Polymerization initiators for the photo-curable compound include, for example, benzophenone, Michler's ketone, 1-hydroxycyclohexyl-phenyl ketone, thioxanthone, benzobutyl ether, acyloxime ester, dibenzothrobene and bisacylphosphine oxide.

There is usable any solvent capable of dissolving the foregoing photo-curable compound or polymerization initiator, as a solvent for the surface layer coating solution. Specific examples thereof include n-butyl alcohol, isopropyl alcohol, ethyl alcohol, methyl alcohol, methyl isobutyl ketone and methyl ethyl ketone.

In the invention, the resin formed by curing a compound having a polar group and a photo-curable functional group refers to a resin that is formed through a polymerization reaction involving the compound having a polar group and a photo-curable functional group.

The surface layer is formed preferably in such a manner that after coating a surface layer coating solution on a previously coated light-sensitive layer, the coated surface layer is subjected to primary drying to the extent that fluidity of the coated layer is lost, exposed to ultraviolet rays to cure the surface layer and further subjected to secondary drying to reduce the content of volatile material of the layer to a prescribed degree.

An ultraviolet exposure device can employ commonly known devices used for curing ultraviolet-curable resins. The ultraviolet dosage ($mJ/cm^2$) for ultraviolet-curing a resin is controlled preferably by ultraviolet exposure intensity and exposure time.

In the invention, the surface layer thickness is preferably from 0.5 to 15 μm, and more preferably from 1 to 10 μm. The surface layer may contain an antioxidant preferably in an amount of from 0.5 to 10 parts by mass of 100 parts by mass of total amount of the photo-curable compound.

Employment of a surface layer constituted as above can achieves improved transferability and electric potential characteristic of a toner even under severe hygrothermal conditions such as high temperature and high humidity and can also obtain a half-toned electrophotographic image with no image unevenness or image deletion.

In the following, there will be described an organic photoreceptor used in the invention.

In the invention, an organic photoreceptor refers to an electrophotographic photoreceptor composed of an organic compound provided with at least one of a charge generation function and a charge transport function which are essential to the constitution of the electrophotographic photoreceptor. Such organic photoreceptors include all of commonly known organic photoreceptors such as a photoreceptor constituted of commonly known organic charge generation materials or organic charge transport material and a photoreceptor constituted of a polymer complex having a charge generating function and a charge transporting function.

The layer structure of the organic photoreceptor of the invention is basically constituted of a light-sensitive layer composed of a charge generation layer and a charge transport layer on an electrically conductive support. Preferably, the light-sensitive layer is constituted of a charge generation layer and plural charge transport layers, and the uppermost charge transport layer constitutes a protective layer.

Next, there will be described the constitution of a photoreceptor.

Conductive Support

An electrically conductive support used for the photoreceptor of the invention is used in a sheet or cylindrical form. The cylindrical conductive support refers to a cylindrical support necessary to be capable of endlessly forming images through rotation. There is preferred a conductive support exhibiting a straightness of not more than 0.1 mm and a deflection of not more than 0.1 mm. Straightness and deflection exceeding these ranges render it difficult to perform superior image formation.

As a conductive support material are usable a metal drum of aluminum, nickel or the like; a plastic drum having deposited aluminum, tin oxide, indium oxide or the like; or a paper-plastic drum coated with a conductive material. A conductive support exhibiting a specific resistance of not more than $10^3$ Ω cm at normal temperature is preferred.

A conductive support used in the invention may employ one having a sealed alumite surface layer. An alumite treatment is conducted usually in an acidic bath of chromic acid, sulfuric acid, oxalic acid, malic acid, boric acid, sulfamic acid or the like, but an anodic oxidation treatment in a sulfuric acid gives rise to most preferable results. The anodic oxidation treatment in a sulfuric acid is carried out preferably at a sulfuric acid concentration of 100 to 200 g/L, an aluminum ion concentration of 1 to 10 g/L, a liquid temperature of approximately 20° C. and an applied voltage of approximately 20 V, but is not limited to these. The average thickness of an anodic oxide coating is preferably not more than 20 μm and more preferably not more than 10 μm.

Interlayer

In the invention, it is preferred to provide an interlayer equipped with barrier function between the conductive support and the light-sensitive layer.

The interlayer of the invention preferably contains particulate titanium oxide in a low water-absorptive binder resin, as described earlier. The average particle size of such titanium oxide particles is preferably not less than 10 and not more than 400 nm in terms of number average primary particle size, and more preferably from 15 to 200 nm. An average particle size of more than 400 nm results in reduced prevention of moire occurrence. An number average primary particle size of more than 400 nm tends to cause sedimentation of titanium oxide particles in an interlayer coating solution, resulting in deteriorated homogeneity of titanium oxide particles dispersed on the interlayer and leading to increased black spots. An interlayer coating solution using titanium oxide particles having an number average primary particle size falling within the foregoing range results in superior dispersion stability and the interlayer formed of such a coating solution inhibits occurrence of black spots and exhibits superior environment characteristics and cracking resistance.

Titanium oxide particles usable in the invention may be in a branched form, a needle form or a particulate form. Titanium oxide particles of such shapes, for instance, include, as a crystalline form, an anatase type, a rutile type and an amorphous type, but any crystalline form may be used or combinations of these crystalline forms are also usable. Of these, rutile type and particulate one are specifically preferred.

Titanium oxide particles used in the invention are preferably subjected to a surface treatment. In one surface treatment, plural surface treatments are conducted, in which the final surface treatment is conducted using a reactive organic silicon compound. Of these plural surface treatments, it is preferred that at least one surface treatment of alumina, silica and zirconia surface treatments is performed and finally, a surface treatment using a reactive organic silicon compound is performed.

The alumina, silica and zirconia surface treatments refer to treatments of allowing alumina, silica and zirconia, respectively, to be deposited on the titanium oxide particle surface. The alumina, silica and zirconia deposited on the surface include hydrates of alumina, silica and zirconia, respectively. The surface treatment using a reactive organic silicon compound means using a reactive organic compound in a treatment solution.

As described above, surface-treating titanium oxide particles at least twice achieves uniform surface coverage (or treatment) of the titanium oxide particles. When the thus surface-treated titanium oxide particles are used in an interlayer, the titanium oxide particles are homogeneously dispersed, leading to a superior photoreceptor not causing an image defect such as black spots.

As a foregoing reactive organic silicon compound is cited a compound represented by the following formula (1):

$$(R)_n—Si—(X)_{4-n} \qquad \text{formula (1)}$$

wherein Si is a silicon atom, R is an organic group with a carbon atom attached to the silicon atom, x is a hydrolysable group, and n is an integer of 0 to 3.

In formula (1), examples of the organic group with a carbon atom attached to the silicon atom, represented by R, include an alkyl group such as methyl, ethyl, propyl, butyl, pentyl, hexyl, octyl and dodecyl; an aryl groups such as phenyl, naphthyl, and biphenyl; an epoxy-containing group such as γ-glycidoxypropyl and β-(3,4-epoxycyclohexyl)ethyl; a (meth)acryloyl-containing group such as γ-acryloxypropyl and γ-methacroxypropyl; a hydroxy-containing group such as γ-hydroxypropyl and 2,3-dihydroxypropyloxypropyl; a vinyl-containing group such as vinyl and propenyl, a mercapto-containing group such as γ-mercaptopropyl; an amino-containing group such as γ-aminopropyl and N-β(aminoethyl)-γ-aminopropyl; a halogen-containing group such as γ-chloropropyl, 1,1,1-trifluoropropyl, nonafluorohexyl and perfluorooctylethyl; and a nitro- or cyano-substituted alkyl group. Further, examples of a hydrolysable group of X include an alkoxy group such as methoxy and ethoxy, a halogen group and an acyloxy group.

Organic silicon compounds of formula (1) may be used singly or in combination.

In formula (1), when n is 2 or more, plural Rs may be the same or different; and when n is 2 or less, plural Rs may be the same or different. Further when two or more organic silicon compounds of formula (1), R and X each may be the same or different between the compounds.

As a reactive organic silicon compound used for a surface treatment preferably is cited a polysiloxane compound. Polysiloxane compounds having a molecular weight of 1,000 to 20,000 are commercially available and exhibit superior function for inhibiting black spots. Specifically, the use of methylhydrogen polysiloxane for the final surface treatment results in superior effects.

Light-Sensitive Layer

Charge Generation Layer

A charge generation layer contains a charge generation material (also denoted as CGM). Other materials may optionally be contained, such as a binder resin and additives.

The organic photoreceptor of the invention can use charge generation materials such as a phthalocyanine pigment, an azo pigment, a perylene pigment and an azulenium pigment, singly or in combinations.

When the charge generation layer uses a binder as a dispersing medium for a CGM, commonly known binder resins are usable and examples of a preferred resin include a formal resin a butyral resin, a silicone resin, a silicone-modified butyral resin and a phenoxy resin. The ratio of a charge generation material to the binder is preferably 20 to 600 parts by mass to 100 parts by mass of the binder. The foregoing resins can minimize an increase of the residual potential, caused along with repeated use. The thickness of a charge generation layer is preferably from 0.1 to 2 μm.

Charge Transport Layer

A charge transport layer contains a charge transport material (hereinafter, also denoted simply as CTM) and a binder resin to disperse the CTM to form a film. There may optionally be contained other materials, for example, additives such as an antioxidant. Commonly known charge transport materials are usable and examples thereof include triphenylamine derivatives, hydrazine compounds, styryl compounds, benzidine compounds and butadiene compounds. Such a charge transport material is dissolved in an appropriate binder to form a layer. Of these, a CTM capable of minimizing an increase of residual potential upon repeating its use is one which exhibits a high mobility and a difference of ionization potential from a combined CGM of not more than 0.5 eV and preferably not more than 0.30 eV. The ionization potential of a CGM or a CTM can be measured by surface analyzer AC-1 (produced by Riken Keiki Co.).

The binder resin used for the charge transport layer can use any of thermoplastic or thermosetting resin. Examples of such resin include polystyrene, an acryl resin, a methacryl resin, a vinyl chloride resin, a vinyl acetate resin, a polyvinyl butyral resin, an epoxy resin, a polyurethane resin, a phenol rein, a polyester resin, an alkyd resin, a polycarbonate resin, a melamine resin and a copolymer resin having at least two repeating units of any of the foregoing resins. In addition to these insulating resins, a polymeric organic semiconductor such as poly-N-vinyl carbazole is also cited. Of the foregoing resins, a polycarbonate resin is specifically preferred in terms of its low moisture absorption, enhanced dispersibility for CTM and superior electrophotographic characteristics.

The ratio of the charge transport material to the binder resin is preferably 50 to 100 parts by mass to 100 parts by mass of the binder resin.

The total thickness of a charge transport layer (comprised of at least one layer, and preferably one to three layers) is preferably from 5 to 25 μm. A layer thickness of less than 5 μm tends to result in an insufficient electrostatic potential, while a layer thickness of more than 25 μm often results in deteriorated sharpness.

Solvents and dispersing media used for an interlayer, a charge generation layer or a charge transport layer include, for example, n-butylamine, diethylamine, ethylenediamine, isopropanolamine, triethanolamine, triethylene diamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide and methyl cellosolve. The invention is not limited to these, but 1,2-dichloromethane, 1,2-dichloroethane and methyl ethyl ketone are preferred. These solvents may be used singly or in combination as mixed solvents.

Usable coating methods for preparation of organic photoreceptors include, for example, immersion coating, spray coating and circular amount control type coating, and to minimize dissolution of a lower layer when coating an upper light-sensitive layer, a spray coating or a circular amount-regulating type coating (typically, a circular slide hopper type coating) is preferred. A protective layer is coated preferably by a circular amount-regulating type coating. The circular amount-regulating type coating is described in, for example, JP-A 58-189061.

In the following, an image forming apparatus using the organic photoreceptor of the invention will be described.

An image forming apparatus I, as illustrated in

FIG. 1, is a digital type image forming apparatus, which comprises an image reading section A', an image processing section B, an image forming section C and a transfer paper conveyance section D as a means for conveying transfer paper.

An automatic manuscript feeder to automatically convey a manuscript is provided above the image reading section. A manuscript placed on a manuscript setting table 11 is conveyed sheet by sheet by a manuscript conveying roller 12 and read at a reading position 13*a* to read images. A manuscript having finished manuscript reading is discharged onto a manuscript discharge tray 14 by the manuscript conveying roller 12.

On the other hand, the image of a manuscript placed on a platen glass 13 is read by a reading action, at a rate of v, of a first mirror unit 15 constituted of a lighting lamp and a first mirror, followed by conveyance at a rate of v/2 toward a second mirror unit 16 constituted of a second mirror and a third mirror which are disposed in a V-form.

The thus read image is formed through a projection lens 17 onto the acceptance surface of an image sensor CCD as a line sensor. Aligned optical images formed on the image sensor CCD are sequentially photo-electrically converted to electric signals (luminance signals), then subjected A/D conversion and further subjected to treatments such as density conversion and a filtering treatment in the image processing section B, thereafter, the image data is temporarily stored in memory.

In the image forming section C, a drum-form photoreceptor 221 as an image bearing body and in its surrounding, a charger 22 (charging step) to allow the photoreceptor 221 to be charged, a potential sensor 220 to detect the surface potential of the charged photoreceptor, a developing device 223 (development step), a transfer conveyance belt device 45 as a transfer means (the transfer step), a cleaning device 26 (cleaning step) for the photoreceptor 221 and a pre-charge lamp (PCL) 27 as a photo-neutralizer (photo-neutralizing step) are disposed in the order to carry out the respective operations. A reflection density detector 222 to measure the reflection density of a patch image developed on the photoreceptor 221 is provided downstream from the developing means 223. The photoreceptor 221, which employs an organic photoreceptor relating to the invention, is rotatably driven clockwise, as indicated.

After having been uniformly charged by the charger 22, the rotating photoreceptor 221 is imagewise exposed through an exposure optical system as an imagewise exposure means 30 (imagewise exposure step), based on image signals called up from the memory of the image processing section B. The exposure optical system as an imagewise exposure means 30 of a writing means employs a laser diode, not shown in the drawing, as an emission light source and its light path is bent by a reflecting mirror 32 via a rotating polygon mirror 31, a fθ lens 34 and a cylindrical lens 35 to perform main scanning. Imagewise exposure is conducted at the position of Ao to the photoreceptor 221 and an electrostatic latent image is formed by rotation of the photoreceptor (sub-scanning). In one of the embodiments, the character portion is exposed to form an electrostatic latent image.

In the image forming apparatus of the invention, a semiconductor laser at a 350-800 nm oscillating wavelength or a light-emitting diode is preferably used as alight source for imagewise exposure. Using such a light source for imagewise exposure, an exposure dot diameter in the main scanning direction of writing can be narrowed to 10-100 μm and digital exposure can be performed onto an organic photoreceptor to realize an electrophotographic image exhibiting a high resolution of 400 to 2500 dpi (dpi: dot number per 2.54 cm). The exposure dot diameter refers to an exposure beam length (Ld, measured at the position of the maximum length) along the main-scanning direction in the region exhibiting an exposure beam intensity of not less than $1/e^2$ of the peak intensity.

Utilized light beams include a scanning optical system using a semiconductor laser and a solid scanner of LED, while the light intensity distribution includes a Gaussian distribution and a Lorentz distribution, but the exposure dot diameter is defined as a region of not less than $1/e^2$ of the respective peak intensities.

An electrostatic latent image on the photoreceptor 21 is reversely developed by the developing device 23 to form a visible toner image on the surface of the photoreceptor 21. In the image foiming method of the invention, the developer used in the developing device preferably is a polymerization toner. The combined use of a polymerization toner which is uniform in shape and particle size distribution and the organic photoreceptor of the invention can obtain electrophotographic images exhibiting superior sharpness.

An electrostatic latent image formed on the organic photoreceptor of the invention is visualized as a toner image through development. The toner used for development may be a pulverized toner or a polymerization toner, of which a polymerization toner prepared by a polymerization method is preferred as a toner relating to the invention in terms of stable particle size distribution.

The polymerization toner refers to a toner which is formed by formation of a binder resin used for the toner, of which the shape is formed through polymerization of a raw material monomer of the binder resin, optionally followed by a chemical treatment. More specifically, it refers to a toner formed through a polymerization reaction such as a suspension polymerization or an emulsion polymerization and subsequent fusion of particles.

The volume average diameter of toner particles, that is, the 50% volume diameter (Dv50) is preferably from 2 to 9 μm, and more preferably from 3 to 7 μm. A particle size falling within this range results in enhanced resolution. Further, even in fine toner particles, a combination of the foregoing ranges can reduce abundance of microscopic particles, resulting in improved reproducibility of dot images over a long period of time and achieving stable image formation of superior sharpness.

The toner relating to the invention may be used as a single-component developer or a two-component developer.

As a single component developer are cited a nonmagnetic single-component developer and a magnetic single-component developer containing magnetic particles of 0.1-0.5 μm and either one is usable in the invention.

The toner relating to the invention is also usable as a two-component developer by mixing a carrier. Commonly known materials are usable as magnetic particles of a carrier and include metals such as iron, ferrite and magnetite and alloys of these metals with a metal such as aluminum or lead. Ferrite particles are specifically preferred. The foregoing magnetic particles preferably exhibit a volume average particle size of 15 to 100 μm, and more preferably 25 to 80 μm. The volume average particle size of a carrier can be measured typically by laser diffraction type particle size distribution measurement apparatus HELOS (produced by SYMPATEC Co.).

A preferred carrier is resin-coated magnetic particles or magnetic particles dispersed in a resin, a so-called resin dispersion type carrier. The resin composition for coating is not specifically limited but there are usable, for example, olefin resin, styrene resin, styrene-acryl resin, silicone resin, ester resin, fluorine-containing resin and the like. A resin to constitute a resin dispersion type carrier is not specifically limited but can employ commonly known ones, for example, styrene-acryl resin, polyester resin, fluororesin, phenol resin and the like.

In the transfer paper conveyance section D, paper supplying units 41(A), 41(B) and 41(C) as a transfer paper housing means for housing transfer paper P differing in size are provided below the image forming unit and a paper hand-feeding unit 42 is laterally provided, and transfer paper P chosen from either one of them is fed by a guide roller 43 along a conveyance route 40. After the fed paper P is temporarily stopped by paired paper feeding resist rollers 44 to make correction of tilt and bias of the transfer paper P, paper feeding is again started and the paper is guided to the conveyance route 40, a transfer pre-roller 43*a*, a paper feeding route 46 and entrance guide plate 47. A toner image on the photoreceptor 221 is transferred onto the transfer paper P at the position of Bo, while being conveyed with being put on a transfer conveyance belt 454 of a transfer conveyance belt device 45 by a transfer pole 224 and a separation pole 25. The transfer paper P is separated from the surface of the photoreceptor 221 and conveyed to a fixing device 50 by the transfer conveyance belt 45.

The fixing device 50 has a fixing roller 51 and a pressure roller 52 and allows the transfer paper P to pass between the fixing roller 51 and the pressure roller 52 to fix the toner by heating and pressure. The transfer paper P which has completed fixing of the toner image is discharged onto a paper discharge tray 64.

Image formation on one side of transfer paper is described above and in the case of two-sided copying, a paper discharge switching member 170 is switched over, and a transfer paper guide section 177 is opened and the transfer paper P is conveyed in the direction of the dashed arrow. Further, the transfer paper P is conveyed downward by a conveyance mechanism 178 and switched back in a transfer paper reverse section 179, and the rear end of the transfer paper P becomes the top portion and is conveyed to the inside of a paper feed unit 130 for two-sided copying.

The transfer paper P is moved along a conveyance guide 131 in the paper feeding direction, transfer paper P is again fed by a paper feed roller 132 and guided into the transfer route 40. The transfer paper P is again conveyed toward the direction of the photoreceptor 221 and a toner is transferred onto the back surface of the transfer paper P, fixed by the fixing device 50 and discharged onto the paper discharge tray 64.

In an image forming apparatus relating to the invention, constituent elements such as a photoreceptor, a developing device and a cleaning device may be integrated as a process cartridge and this unit may be freely detachable. At least one of an electrostatic charger, an image exposure device, a transfer or separation device and a cleaning device is integrated with a photoreceptor to form a process cartridge as a single detachable unit from the apparatus body and may be detachable by using a guide means such as rails in the apparatus body.

Figure 2:
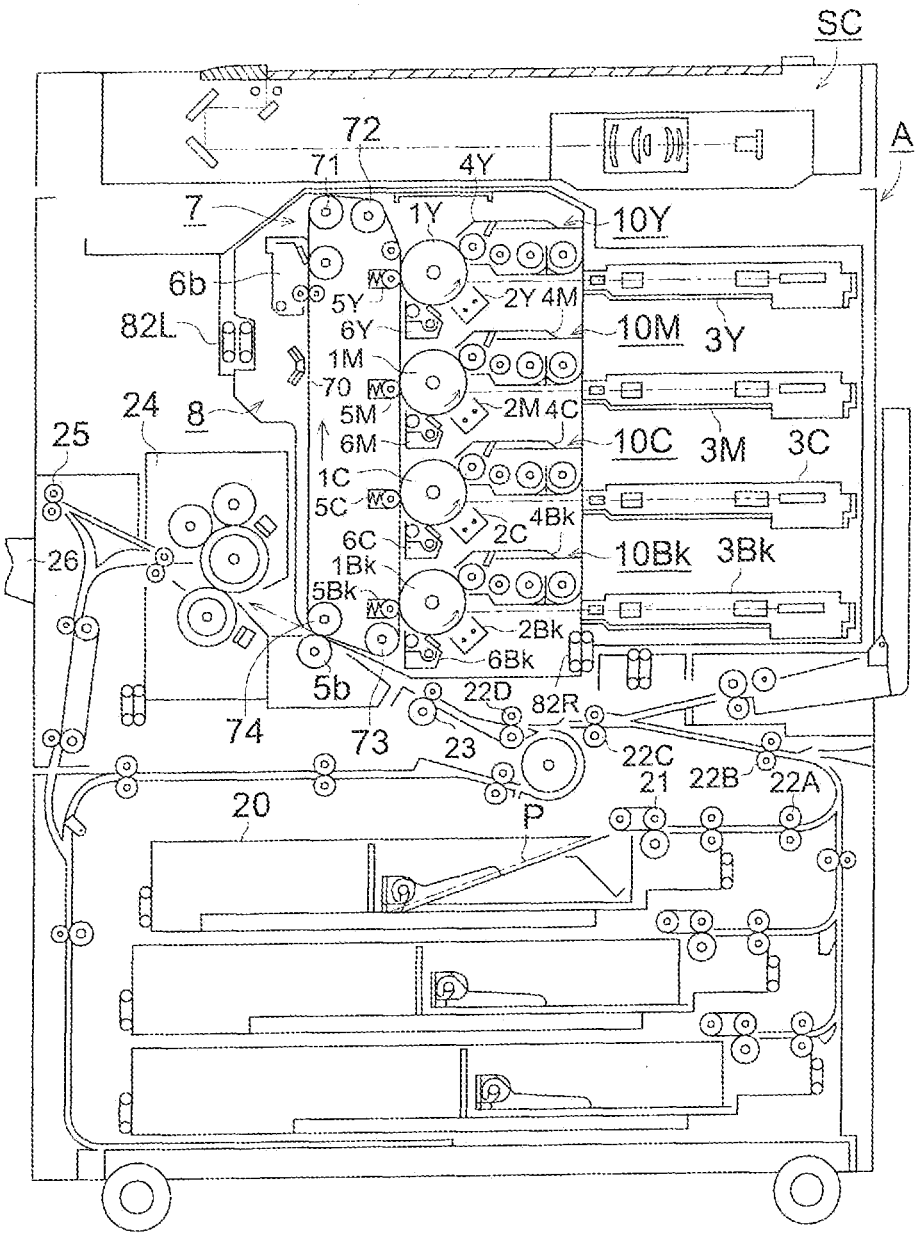
FIG. 2 illustrates a sectional view of a color image forming apparatus relating to the invention.

FIG. 2 illustrates a sectional view of a color image forming apparatus showing one of the embodiments of the invention.

This image forming apparatus is called a tandem color image forming apparatus, which is, as a main constitution, comprised of four image forming sections (image forming units) 10Y, 10M, 10C and 10Bk; an intermediate transfer material unit 7 of an endless belt form, a paper feeding and conveying means 21 and as a fixing means 24. Original image reading device SC is disposed in the upper section of image forming apparatus body A.

Image forming section 10Y to form a yellow image comprises a drum-form photoreceptor 1Y as the first photoreceptor; an electrostatic-charging means 2Y (electrostatic-charging step), an exposure means 3Y (exposure step), a developing means 4Y (developing step), a primary transfer roller 5Y (primary transfer step) as a primary transfer means; and a cleaning means 6Y, which are disposed around the photoreceptor 1Y.

An image forming section 10M to form a magenta image comprises a drum-form photoreceptor 1M as the second photoreceptor; an electrostatic-charging means 2M, an exposure means 3M and a developing means 4M, a primary transfer roller 5M as a primary transfer means; and a cleaning means 6M, which are disposed around the photoreceptor 1M.

An image forming section 10C to form a cyan image formed on the respective photoreceptors comprises a drum-form photoreceptor 1C as the third photoreceptor, an electrostatic-charging means 2Y, an exposure means 3C, a developing means 4C, a primary transfer roller SC as a primary transfer means and a cleaning means 6C, all of which are disposed around the photoreceptor 1C.

An image forming section 10Bk to form a black image formed on the respective photoreceptors comprises a drum-form photoreceptor 1Bk as the fourth photoreceptor; an electrostatic-charging means 2Bk, an exposure means 3Bk, a developing means 4Bk, a primary transfer roller 5Bk as a primary transfer means and a cleaning means 6Bk, which are disposed around the photoreceptor 1Bk.

The foregoing four image forming units 10Y, 10M, 10C and 10Bk are comprised of centrally-located photoreceptor drums 1Y, 1M, 1C and 1Bk; rotating electrostatic-charging means 2Y, 2M, 2C and 2Bk; imagewise exposure means 3Y, 3M, 3C and 3Bk; rotating developing means 4Y, 4M, 4C and 4Bk; and cleaning means 5Y, 5M, 5C and 5Bk for cleaning the photoreceptor drums 1Y, 1M, 1C and 1Bk.

The image forming units 10Y, 10M, 10C and 10Bk are different in color of toner images formed in the respective photoreceptors 1Y, 1M, 1C and 1Bk but are the same in constitution, and, for example, the image forming unit 10Y will be described below.

The image forming unit 10Y disposes, around the photoreceptor 1Y, an electrostatic-charging means 2Y (hereinafter, also denoted as a charging means 2Y or a charger 2Y), an exposure means 3Y, developing means (developing step) 4Y, and a cleaning means 5Y (also denoted as a cleaning blade 5Y, and forming a yellow (Y) toner image on the photoreceptor 1Y. In this embodiment, of the image forming unit 10Y, at least the photoreceptor unit 1Y, the charging means 2Y, the developing means 4Y and the cleaning means 5Y are integrally provided.

The charging means 2Y is a means for providing a uniform electric potential onto the photoreceptor drum 1Y. In the embodiment, a corona discharge type charger 2Y is used for the photoreceptor 1Y.

The imagewise exposure means 3Y is a mean which exposes, based on (yellow) image signals, the photoreceptor drum 1Y having a uniform potential given by the charger 2Y to form an electrostatic latent image corresponding to the yellow image. As the exposure means 3Y is used one composed of an LED arranging emission elements arrayed in the axial direction of the photoreceptor drum 1Y and an imaging device (trade name: selfoc lens), or a laser optical system.

In the image forming apparatus relating to the invention, the above-described photoreceptor and constituting elements such as a developing device and a cleaning device may be integrally combined as a process cartridge (image forming unit), which may be freely detachable from the apparatus body. Further, at least one of a charger, an exposure device, a developing device, a transfer or separating device and a cleaning device is integrally supported together with a photoreceptor to form a process cartridge as a single image forming unit which is detachable from the apparatus body by using a guide means such as a rail of the apparatus body.

Intermediate transfer unit 7 of an endless belt form is turned by plural rollers and has intermediate transfer material 70 as the second image carrier of an endless belt form, while being pivotably supported.

The individual color images formed in image forming sections 10Y, 10M, 10C and 10Bk are successively transferred onto the moving intermediate transfer material (70) of an endless belt form by primary transfer rollers 5Y, 5M, 5C and 5Bk, respectively, to form a composite color image. Recording member P of paper or the like, as a final transfer material housed in a paper feed cassette 20, is fed by paper feed and a conveyance means 21 and conveyed to a secondary transfer roller 5*b* through plural intermediate rollers 22A, 22B, 22C and 22D and a resist roller 23, and color images are secondarily transferred together on the recording member P. The color image-transferred recording member (P) is fixed by a heat-roll type fixing device 24, nipped by a paper discharge roller 25 and put onto a paper discharge tray outside a machine. Herein, a transfer support of a toner image formed on the photoreceptor, such as an intermediate transfer body and a transfer material collectively means a transfer medium.

After a color image is transferred onto a transfer material P by a secondary transfer roller 5*b* as a secondary transfer means, an intermediate transfer material 70 of an endless belt form which separated the transfer material P removes any residual toner by cleaning means 6*b*.

During the image forming process, the primary transfer roller 5Bk is always in contact with the photoreceptor 1Bk. Other primary transfer rollers 5Y, 5M and 5C are each in contact with the respectively corresponding photoreceptors 1Y, 1M and 1C only when forming a color image.

The secondary transfer roller 5*b* is in contact with the intermediate transfer material 70 of an endless belt form only when the transfer material P passes through to perform secondary transfer.

A housing 8, which can be pulled out from the apparatus body A through supporting rails 82L and 82R, is comprised of image forming sections 10Y, 10M, 10C and 10Bk and the endless belt intermediate transfer unit 7.

Image forming sections 10Y, 10M, 10C and 10Bk are aligned vertically. The endless belt intermediate transfer material unit 7 is disposed on the left side of photoreceptors 1Y, 1M, 1C and 1Bk, as indicated in FIG. 2. The intermediate transfer material unit 7 comprises the endless belt intermediate transfer material 70 which can be turned via rollers 71, 72, 73 and 74, primary transfer rollers 5Y, 5M, 5C and 5Bk and cleaning means 6*b*.

Figure 3:
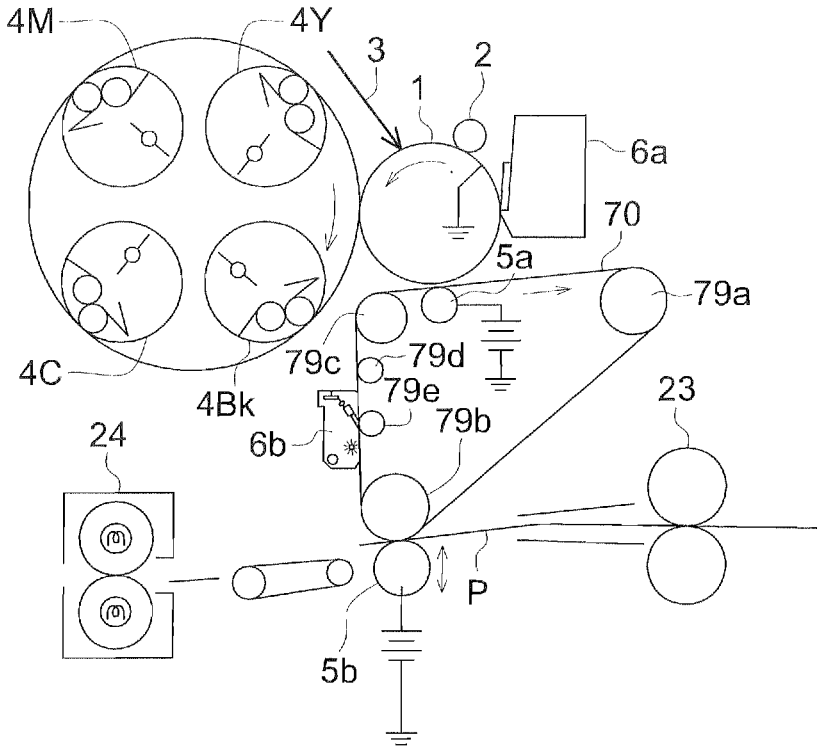
FIG. 3 illustrates a sectional view of a color image forming apparatus using an organic photoreceptor according to the invention.

FIG. 3 illustrates a sectional view of a color image forming apparatus using an organic photoreceptor according to the invention (a copier or a laser beam printer which comprises, around the organic photoreceptor, an electrostatic-charging means, an exposure means, plural developing means, a transfer means, a cleaning means and an intermediate transfer means). The intermediate transfer material 70 of an endless belt form employs an elastomer of moderate resistance.

The numeral 1 designates a rotary drum type photoreceptor, which is repeatedly used as an image forming body, is rotatably driven anticlockwise, as indicated by the arrow, at a moderate circumferential speed.

The photoreceptor 1 is uniformly subjected to an electrostatic-charging treatment at a prescribed polarity and potential by a charging means 2 (charging step), while being rotated. Subsequently, the photoreceptor 1 is subjected to imagewise exposure via an imagewise exposure means 3 (imagewise exposure step) by using scanning exposure light of a laser beam modulated in correspondence to the time-series electric digital image signals of image data to form an electrostatic latent image corresponding to a yellow (Y) component image (color data) of the objective color image.

Subsequently, the electrostatic latent image is developed by a yellow toner of a first color in a yellow (Y) developing means 4Y: developing step (the yellow developing device). At that time, the individual developing devices of the second to fourth developing means 4M, 4C and 4Bk (magenta developing device, cyan developing device, black developing device) are in operation-off and do not act onto the photoreceptor 1 and the yellow toner image of the first color is not affected by the second to fourth developing devices.

The intermediate transfer material 70 is rotatably driven clockwise at the same circumferential speed as the photoreceptor 1, while being tightly tensioned onto rollers 79*a*, 79*b*, 79*c*, 79*d* and 79*e*.

The yellow toner image formed and borne on the photoreceptor 1 is successively transferred (primary-transferred) onto the outer circumferential surface of the intermediate transfer material 70 by an electric field formed by a primary transfer bias applied from a primary transfer roller 5*a* to the intermediate transfer material 70 in the course of being passed through the nip between the photoreceptor 1 and the intermediate transfer material 70.

The surface of the photoreceptor 1 which has completed transfer of the yellow toner image of the first color is cleaned by a cleaning device 6*a*.

In the following, a magenta toner image of the second color, a cyan toner image of the third color and a black toner image of the fourth color are successively transferred onto the intermediate transfer material 70 and superimposed to form superimposed color toner images corresponding to the intended color image.

A secondary transfer roller 5*b*, which is allowed to bear parallel to a secondary transfer opposed roller 79*b*, is disposed below the lower surface of the intermediate transfer material 70, while being kept in the state of being separable.

The primary transfer bias for transfer of the first to fourth successive color toner images from the photoreceptor 1 onto the intermediate transfer material 70 is at the reverse polarity of the toner and applied from a bias power source. The applied voltage is, for example, in the range of +100 V to +2 kV.

In the primary transfer step of the first through third toner images from the photoreceptor 1 to the intermediate transfer material 70, the secondary transfer roller 5*b* and the cleaning means 6*b* for the intermediate transfer material are each separable from the intermediate transfer material 70.

The superimposed color toner image which was transferred onto the intermediate transfer material 70 is transferred to a transfer material P as the second image bearing body in the following manner. Concurrently when the secondary transfer roller 5*b* is brought into contact with the belt of the intermediate transfer material 70, the transfer material P is fed at a prescribed timing from paired paper-feeding resist rollers 23, through a transfer paper guide, to the nip in contact with the belt of the intermediate transfer material 70 and the secondary transfer roller 5*b*. A secondary transfer bias is applied to the second transfer roller 5*b* from a bias power source. This secondary bias transfers (secondary-transfers) the superimposed color toner image from the intermediate transfer material 70 to the transfer material P as a secondary transfer material. The transfer material P having the transferred toner image is introduced to a fixing means 24 and is subjected to heat-fixing.

The image forming apparatus relating to the invention is not only suitably used for general electrophotographic apparatuses such as an electrophotographic copier, a laser printer, an LED printer and a liquid crystal shutter type printer, but is also broadly applicable to apparatuses employing electrophotographic technologies for a display, recording, shortrun printing, printing plate making, facsimiles and the like.

EXAMPLES

The present invention will be further described with reference to examples but the embodiments of the invention are by no means limited to these. In the following examples, "part(s)" represents part(s) by mass unless otherwise noted.

Preparation of Photoreceptor 1

Photoreceptor 1 was prepared in the following manner.

The surface of a cylindrical aluminum support was machine-cut to prepare an electrically conductive support exhibiting a surface roughness (Rz) of 1.5 (μm).

Interlayer

A dispersion having the composition described below was diluted two times with the same solvent as used therein, allowed to stand overnight and then filtered with a filter (Rigimesh 5 μm filter, produced by Nippon Paul Co.) to prepare an interlayer coating solution.

| | |
|---|---|
| Polyamine resin CM 8000 (produced by Toray Co.) | 1 part |
| Titanium oxide SMT 500 SAS (produced by Teika Co.) | 3 parts |
| Methanol | 10 parts |

Using a sand mill, the foregoing mixture was dispersed in a batch system over 10 hrs. to obtain a coating solution. The coating solution was coated onto the support described above by the dipping method to dry thickness of 2 μm.

Charge Generation Layer

| | |
|---|---|
| Charge generation material: titanyl phthalocyanine pigment* | 20 parts |
| Polyvinyl butyral resin (#6000-C: Produced by DENKI KAGAKU KOGYO Co.) | 10 parts |
| Methyl acetate | 700 parts |
| Methoxy-4-methyl-2-pentanone | 300 parts |

As the charge generation material was used a titanyl phthalocyanine pigment (exhibiting a maximum diffraction peak at 27.3° in Cu—Kα characteristic X-ray diffraction profile). The foregoing mixture was dispersed in a sand mill over 10 hrs. to prepare the coating solution for a charge generation layer. The coating solution was coated onto the foregoing interlayer by the dipping method to form a charge generation layer having a dry thickness of 0.3 μm.

Charge Transport Layer

| | |
|---|---|
| Charge transport material [4,4'-dimethyl-4''-(-phenylstyryl)triphenylamine] | 225 parts |
| Binder (polycarbonate Z300, Mitsubishi Gas Kagaku Co., Ltd.) | 300 parts |

-continued

| | |
|---|---|
| Antioxidant (Irganox 1010, Nippon Chiba Geigy) | 6 parts |
| Dichloromethane | 2000 parts |
| Oil (KF-54, Shinetsu Kagaku Co.) | 1 part |

The foregoing mixture was dissolved to prepare a coating solution for a charge transport layer. Using a slide hopper coater, the coating solution was coated onto the charge generation layer to form a charge transport layer having a dry thickness of 20 μm.

Surface Layer

| | |
|---|---|
| Metal oxide particle (Silica particles, number average particle size: 10 nm, moisture content: 0.1%) | 10 parts |
| Photocurable compound (17) having a polar group and a photocurable functional group | 20 parts |
| Polymerization initiator [1-hydroxy-cyclohexyl(phenyl)methanone] | 1 parts |
| THF (tetrahydrofuran) | 10 parts |
| Isopropyl alcohol | 40 parts |

The foregoing components were mixed with stirring until being sufficiently dissolved and dispersed to prepare a coating solution of a surface layer. Using a slide-hoper coater, the coating solution for a surface layer was coated onto the charge transport layer of the photoreceptor that had been prepared by then. After completion of coating, the coated layer was dried at 90° C. for 20 min. (solvent drying step S3) and then exposed to ultraviolet rays for 1 min. by using a low-pressure ultraviolet lamp (ultraviolet curing step S4) to form a surface layer having a dry thickness of 5.0 μm.

Preparation of Photoreceptors 2-10

Photoreceptors 2-10 were prepared similarly to the foregoing photoreceptor 1, provided that the metal oxide particle and the photocurable compound having a polar group and a photocurable functional group were varied as shown in Table 1.

TABLE 1

| | Photocurable Compound | | | Metal Oxide | | | |
|---|---|---|---|---|---|---|---|
| Photoreceptor No. | No. | Polar Group | Photocurable Group | Metal Oxide | Particle Size*1 (nm) | Hydrophobilizing Agent | Water Absorption (%) |
| 1 | (17) | —CONH— | acryloyl | silica | 10 | methyltrimethoxysilane | 0.1 |
| 2 | (19) | —CONH— | acryloyl | titanium oxide | 95 | methylhydrogen polysiloxane | 3.0 |
| 3 | (13) | —OH | acryloyl | titanium oxide | 6 | butyltrimethoxysilane | 10.0 |
| 4 | (21) | —CONH— | acryloyl | titanium oxide | 25 | methylhydrogen polysiloxane | 5.0 |
| 5 | (25) | —CONH— | acryloyl | titanium oxide | 120 | hexamethyl-di-silane | 7.0 |
| 6 | (19) | —CONH— | acryloyl | silica | 9 | isobutyltrimethoxysilane | 2.5 |
| 7 | (27) | —CONH— | methacryloyl | titanium oxide | 25 | phenyltrimethoxysilane | 15.0 |
| 8 | (26) | —CONH— | acryloyl | titanium oxide | 25 | o-methylphenyltrimethoxysilane | 20.0 |
| 9 | (25) | —CONH— | acryloyl | titanium oxide | 13 | phenyltrimethoxysilane | 0.08 |
| 10 | styrene | — | vinyl | titanium oxide | 95 | p-methylphenyltrimethoxysilane | 3.0 |

*1Number average primary particle size

The thus prepared photoreceptors were evaluated as below.

Layer Hardness

The layer hardness (or strength) was evaluated in such a manner that a Vickers indenter (square pyramidal indenter at an angle of 136°) was set in Fischer Scope H100, produced by Fischer Instrument Co., whereby a universal hardness (HU) was measured at an indentation speed of 0.4 mN/sec and an indentation weight of 2 mN, a retention time of 5 sec., and a measurement environment of 20° C. and 65% RH.

Image Deletion

Laser Printer LP1500C (4-cycle intermediate system provided with laser exposure, reversal development, an intermediate transfer belt and blade cleaning process) was used as an evaluation machine. The photoreceptors were each loaded into the evaluation machine in which exposure was optimized, the initial charged electric potential was set to −450 V and 80 sheets of A4 full-color image were continuously printed under high temperature and high humidity (38° C., 80% RH). Before and after this imaging, a text image of a dot area ratio of 7% was printed and the obtained halftone image was visually evaluated based on the following criteria:

A: even after 80 printed sheets, no image deletion was observed and a superior image was obtained, B: after 80 printed sheets, image deletion occurred, C: even before 80 printed sheets, image deletion occurred.

Potential after Exposure

The electric potential after exposure was measured as a measure of an electric characteristic. Using CYNTHIA A59, the photoreceptors were each charged in the dark at 20° C. and 65% RH by a scorotron charger so that the surface potential was −500 V; after 33 msec., the charged photoreceptors were subjected to white exposure at an intensity of 148 μW/cm$^2$ and the potential on the surface of each of the exposed photoreceptors was measured.

Evaluation results are shown in Table 2.

TABLE 2

| Photoreceptor No. | Layer Hardness (N/mm$^2$) | Image Deletion | Potential After Exposure (V) | Remark |
|---|---|---|---|---|
| 1 | 310 | A | −67 | Inv. |
| 2 | 344 | B | −58 | Inv. |
| 3 | 305 | B | −85 | Inv. |
| 4 | 332 | B | −70 | Inv. |
| 5 | 315 | A | −80 | Inv. |
| 6 | 298 | A | −90 | Inv. |
| 7 | 220 | C | −70 | Comp. |
| 8 | 336 | C | −84 | Comp. |
| 9 | 283 | C | −105 | Comp. |
| 10 | 255 | C | −95 | Comp. |

As can be seen from Table 2, it was proved that organic photoreceptors of the invention were sufficient in layer durability and superior in evaluation of image deletion, as compared to organic photoreceptors of comparison, and the potential after subjected to exposure was less than 100 V, whereby practical usefulness was sufficiently ensured.

What is claimed is:

1. An organic photoreceptor comprising on an electrically conductive support a light-sensitive layer and a surface layer, wherein the surface layer comprises a resin formed by curing a compound having at least one polar group and at least one photocurable-functional group and a particulate metal oxide having a water absorption of 0.1 to 10% wherein the particulate metal oxide is subjected to a hydrophobilization treatment.

2. The organic photoreceptor of claim 1, wherein the metal oxide is selected from the group consisting of a silica, a titanium oxide and an aluminum oxide.

3. The organic photoreceptor of claim 1, wherein the metal oxide is a titanium oxide.

4. The organic photoreceptor of claim 1, wherein the particulate metal oxide has a number average primary particle size of 10 to 100 nm.

5. The organic photoreceptor of claim 1, wherein the particulate metal oxide is contained in an amount of 1 to 55 parts by mass, based on 100 parts by mass of the resin.

6. The organic photoreceptor of claim 1, wherein the hydrophobilization treatment is conducted using at least one hydrophobilizing agent selected from the group consisting of a titanium coupling agent, a silane coupling agent, a silicon oil and a hydrogen polysiloxane compound.

7. The organic photoreceptor of claim 1, wherein the polar group is at least one selected from the group consisting of —OH, —CHO, —$NH_2$, —COOH and —CONH—.

8. The organic photoreceptor of claim 1, wherein the photocurable-functional group is at least one selected from the group consisting of an acryloyl group, a methacryloyl group and an epoxy group.

9. The organic photoreceptor of claim 1, wherein the compound contains at least two photocurable-functional groups.

10. The organic photoconductor of claim 1, wherein the resin is one formed by polymerizing the compound having a polar group and a photo-curable functional group.

11. The organic photoconductor of claim 1, wherein the surface layer is formed by a process comprising (i) coating a solution containing the compound having at least one polar group and at least one photocurable-functional group and a particulate metal oxide on the light-sensitive layer to form the surface layer and (ii) exposing the surface layer to ultraviolet rays.

12. An image forming apparatus comprising a developing device to develop an electrostatic image formed on an organic photoreceptor to form a toner image, a transfer device for transferring the toner image to a transfer paper and a cleaning device for removing a toner remaining on the organic photoreceptor, wherein the organic photoreceptor comprises on an electrically conductive support a light-sensitive layer and a surface layer, and the surface layer comprises a resin formed by curing a compound containing a polar group and a photocurable functional group and a particulate metal oxide having a water absorption of 0.1 to 10%.

13. A process cartridge, wherein an organic photoreceptor as claimed in claim 1 which is integrated with at least one of a charger, an image exposure device, a development device and a cleaning device to form a cartridge and the cartridge is designed so as to be freely transferable into and from an image forming apparatus.

* * * * *